106-85 AU 118 EX
12/16/86 XR 4,629,708

United States Patent [19]

Alexander et al.

[11] Patent Number: 4,629,708

[45] Date of Patent: Dec. 16, 1986

[54] MOULDING

[75] Inventors: Kevin Alexander, Stoke-on-Trent; Howard J. Farr, Northampton, both of England

[73] Assignee: Doulton Industrial Products Limited, Stone, England

[21] Appl. No.: 611,492

[22] Filed: May 17, 1984

[30] Foreign Application Priority Data

May 20, 1983 [GB] United Kingdom ..... 8314089

[51] Int. Cl.[4] ..... C04B 35/02

[52] U.S. Cl. ..... 501/123; 106/38.2; 106/38.3; 106/85; 164/522; 164/529

[58] Field of Search ..... 501/123, 154; 106/85, 106/38.2, 38.3; 164/132, 522, 529

[56] References Cited

U.S. PATENT DOCUMENTS

| | | | |
|---|---|---|---|
| 2,687,967 | 8/1954 | Yedlick et al. | 501/154 X |
| 3,801,334 | 4/1974 | Dewey, Jr. | 164/522 X |
| 4,480,681 | 11/1984 | Alexander et al. | 164/522 |

FOREIGN PATENT DOCUMENTS

| | | | |
|---|---|---|---|
| 1646842 | 5/1973 | Fed. Rep. of Germany | 501/154 |
| 1429555 | 3/1976 | United Kingdom | 106/85 |
| 2105312 | 3/1983 | United Kingdom . | |
| 768528 | 10/1980 | U.S.S.R. | 164/522 |

*Primary Examiner*—William R. Dixon, Jr.
*Assistant Examiner*—Steven Capella
*Attorney, Agent, or Firm*—Frost & Jacobs

[57] ABSTRACT

A core or insert primarily for the production of metal and alloy castings, e.g. of complicated internal shape, is a refractory body comprising essentially a water-soluble salt and a calcium silicate, the calcium silicate being present in amount of at least 45%, by weight, based on the total weight of calcium silicate and water-soluble salt, and the water-soluble salt and the calcium silicate having a particular particle size distribution. The calcium silicate is preferably a wollastonite.

The core may be removed from the cast or moulded article by dissolution in water.

11 Claims, 1 Drawing Figure

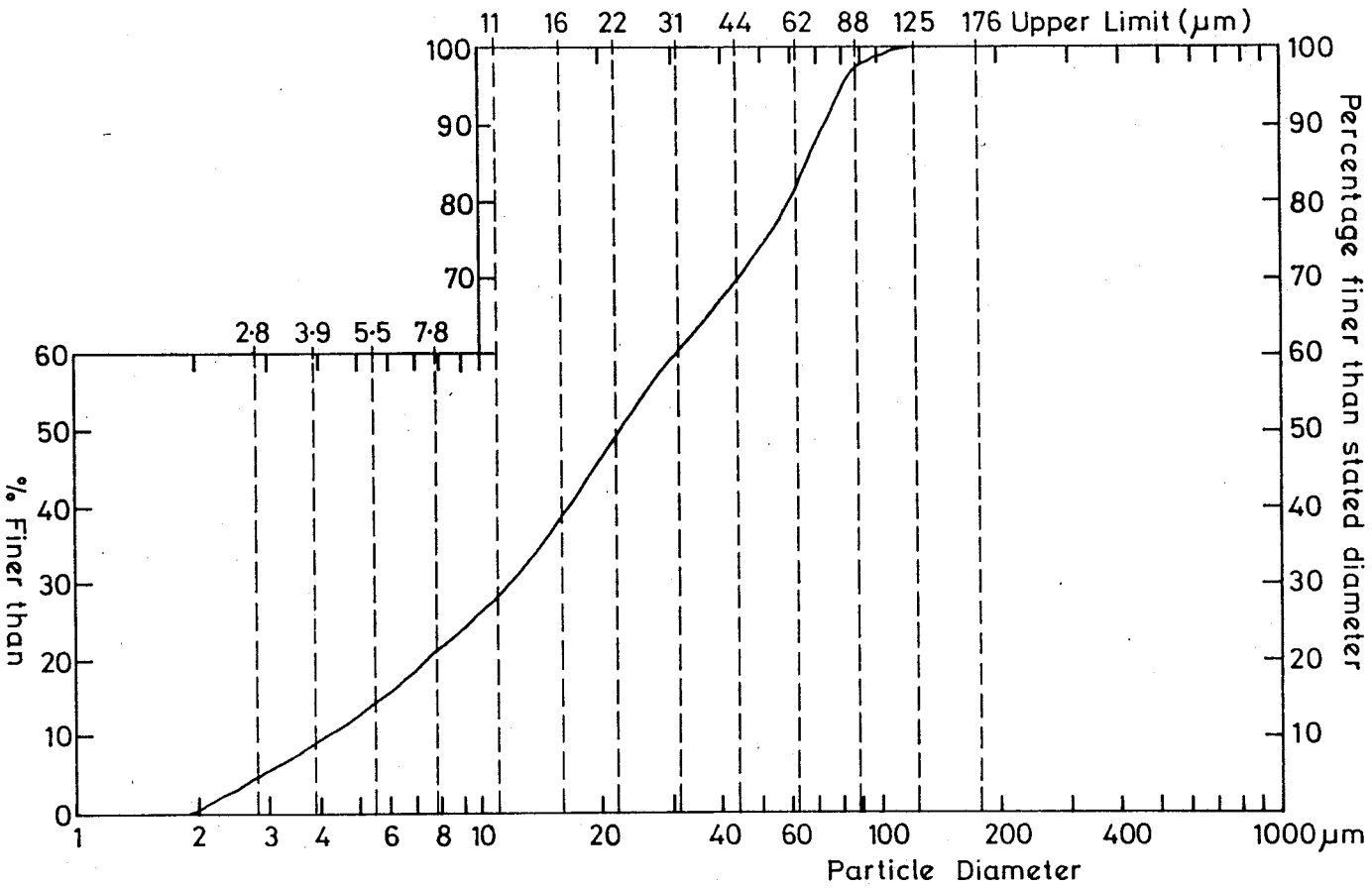
Percentage finer than stated diameter
100
90
80
70
60
50
40
30
20
10
1000μm
400
200
100
60
40
20
10
8
6
4
3
2
1
Particle Diameter
176 Upper Limit (μm)
125
88
62
44
31
22
16
11
100
90
80
70
7·8
5·5
3·9
2·8
60
50
40
30
20
10
0
% Finer than

MOULDING

This invention relates to the shaping of mouldable materials, e.g. the production of metal and alloy castings, and is especially concerned with the provisions of a novel core or insert for use therein. It is more especially concerned with the provision of a core or insert for use in casting metals and metal alloys, e.g. light metal alloys.

It is well known to employ, for the production of castings, cores or inserts made from a ceramic composition, around which the metal or alloy is cast, and which are removed after casting by mechanical means, for example percussion drilling, or in the case of complex core shapes by dissolution in a solvent which does not react with the metal of the casting.

U.K. Patent Specification No: 1,005,136 describes the production of a core or insert by moulding a mixture comprising powdered tricalcium silicate or a precursor and a binder into the desired shape, and then firing the formed shape at a temperature in the range 1075° C. to 1125° C. Cores thus formed are especially useful in the casting of metals and alloys such as aluminium and aluminium alloys, from which they may subsequently be removed by dissolution in 50% nitric acid. Cores removable by dissolution in molten caustic soda are described in U.K. Patent Specification No: 1,013,938, according to which they are formed from a mixture comprising from 30–70% of titanium oxide and one or more oxides or precursors of barium, calcium, strontium, magnesium or aluminium. U.K. Patent Specification No: 1,070,382 describes the manufacture of a core, with or without a mould integral with the core, by firing a shape formed from zirconium oxide or silicate together with one or more oxides or oxide precursors of group IIA metals and/or one or more other refractory oxides or precursors. The cores are said to be useful in the casting of nickel-based alloys, from which they are subsequently removed by treatment with molten or aqueous caustic soda or hydrofluoric acid. In U.K. Patent Specification No: 1,115,441, there is described a mould/core useful for metal and alloy castings, especially aluminium alloy castings, formed from calcium phosphate and removable from the formed casting by treatment with nitric acid. A core suitable for the casting of group IV Transition metals is described in U.K. Patent Specification No: 1,299,901, according to which the core is made from alumina, magnesia and/or zirconia and is treated after firing with a carbonaceous material to leave a proportion of finely divided carbon or graphite in the internal and/or external layers.

Cores and moulds made according to these descriptions have been used to a substantial extent. Despite the success of these cores there has grown up in the metal-working industry a demand for a core which, whilst possessing the advantages of the known cores, is soluble in water so that it may be readily removed from the formed shape, often having a very complicated internal shaped, by simply dipping into a bath of water. Such a water-soluble core is described in U.K. Specification No: 2105312A.

That Specification describes a refractory body comprising essentially a water-soluble salt having the following particle size distribution: 100% by weight of the particles have a size of 750 μm or less; 90% by weight of the particles have a size of 8–600 μm; 80% by weight of the particles have a size of 5.5–500 μm; 70% by weight of the particles have a size of 4–400 μm; 60% by weight of the particles have a size of 2.8–350 μm; 50% by weight of the particles have a size of 2.0–280 μm; 40% by weight of the particles have a size of 1.6–220 μm; 30% by weight of the particles have a size of 1.0–180 μm; 20% by weight of the particles have a size of 0.3–160 μm; 10% by weight of the particles have a size of 0.1–125 μm;

In a preferred aspect of the invention described in U.K. Specification No: 2105312A, the water-soluble salt has a particle size distribution as follows:

between 8 and 11% by weight of the particles have a particle size less than 3 μm;
between 9 and 14 % by weight of the particles have a particle size less than 4 μm;
between 12 and 19% by weight of the particles have a particle size less than 6 μm;
between 15 and 23% by weight of the particles have a particle size less than 8 μm; between 19 and 29% by weight of the particles have a particle size less than 11 μm;
between 25 and 36% by weight of the particles have a particle size less than 16 μm;
between 31 and 42% by weight of the particles have a particle size less than 22 μm;
between 38 and 50% by weight of the particles have a particle size less than 31 μm;
between 44 and 58% by weight of the particles have a particle size less than 44 μm;
between 54 and 68% by weight of the particles have a particle size less than 62 μm;
between 65 and 77% by weight of the particles have a particle size less than 88 μm;
between 75 and 85% by weight of the particles have a particle size less than 125 μm;
100% by weight of the particles have a particle size less than 175 μm.

It has been found in practice that some cores made in accordance with U.K. Specification No: 2105312A suffer from certain disadvantages which make them less than totally satisfactory in use. Thus, it has been noticed that when the core contains a high proportion, e.g. of the order of 95% by weight, of sodium chloride as the water-soluble salt, the core exhibits a high coefficient of expansion. This has led to linear expansions, at the temperature of casting using the cores, of up to 3%, and this has in turn led to unsatisfactory distortion and, in some cases, breakage during use. An additional difficulty has been the inadvertent premature subjection of the cores to the action of water, for example during storage or transport, leading to premature dissolution of some of the water-soluble component of the cores.

It is an object of the present invention to provide a body for use as a core or insert in metal casting which does not suffer from these difficulties, and according to the present invention a refractory body comprises a composition containing a water-soluble salt and a calcium silicate, wherein both the water-soluble salt and the calcium silicate have particle size distributions as set out in U.K. Specification No: 2105312A and wherein the composition contains at least 45%, preferably at least 60%, by weight, of the calcium silicate, based on the total weight of calcium silicate and water-soluble salt.

The invention also provides a method of producing a casting of a castable metal or alloy, comprising forming a mould including a mould and/or cores(s) constituted by a composition as set out in the preceding paragraph, introducing into the mould assembly a charge of the castable metal or alloy in molten form, allowing the charge to solidify, and removing the mould and/or core(s) from the casting so formed.

Suitable water-soluble salts for use in manufacturing the cores/moulds of the present invention include sodium and potassium chlorides and sodium metasilicate. Sodium chloride is the preferred salt, and of course has the advantage of being readily available in economically attractive quantities. Of course, the precise water-soluble salt used in any particular case will be chosen having regard to the fact that it must not melt or decompose at the temperature of use, i.e. approximately the melting point of the metal or other material being cast or moulded around it. For example, sodium chloride, having a melting point of 800° C., is eminently suitable for use in casting aluminium, melting point 660° C. So also are potassium chloride and sodium metasilicate (melting points 776° C. and 1088° C. respectively).

In a preferred composition according to the invention, the water-soluble salt forms between 20 and 28%, most suitably between 23 and 28%, and the calcium silicate forms between 80 and 72%, most suitably between 77 and 72%, based on the total weight of water-soluble salt and calcium silicate.

Particularly suitable calcium silicates are the wollastonites, and natural wollastonite is especially preferred, although pseudo-wollastonite is also suitable. The most useful calcium silicates are those having particle size distributions such that 90% by weight have particle sizes less than 200 μm. An especially useful wollastonite has a particle size distribution as follows:

10% by weight have a particle size less than 5 μm;
20% by weight have a particle size less than 8 μm;
30% by weight have a particle size less than 15 μm;
40% by weight have a particle size less than 20 μm;
50% by weight have a particle size less than 25 μm;
60% by weight have a particle size less than 35 μm;
70% by weight have a particle size less than 50 μm;
80% by weight have a particle size less than 65 μm;
90% by weight have a particle size less than 80 μm;
100% by weight have a particle size less than 150 μm.

A particularly useful wollastonite has the particle size distribution shown on the accompanying drawing.

The cores of the invention are suitably manufactured by forming a mixture comprising the water-soluble salt, the calcium silicate and a temporary binder, shaping the mixture into the desired form, and firing the form inter alia to remove the binder. The mixture may contain other materials as required, for example to enhance certain desirable properties of the core, and such additional ingredients may include for example one or more of silica, alumina, zircon, aluminosilicates, talc, magnesia, titania, mullite, ground porcelain and sillimanite. The additional ingredients preferably melt at temperatures above 800° C., most preferably above 1000° C., and may be present in the core-forming mixture in amounts up to 10% by weight of the total mixture, most suitably in amounts of 2.0 to 2.5%, on the same basis.

The temporary binder, used to bind the ingredients of the core-forming mixture together during shaping thereof, and which is burnt off during firing, may be any of the known binders described in the prior Specifications discussed above. Thus, the binder may be a paraffin wax, a synthetic organic resin such as a polystyrene or a silicone resin. We prefer however to use a polyethylene glycol, suitably one having a molecular weight in the range 4000–8000, and most preferably one of molecular weight 6000. The binder is preferably present in just such an amount as will fill the voids in a randomly packed powder and will allow shaping.

It is necessary that the water-soluble salt should be wetted by the binder. In some cases, the presence of a wetting agent may be required in order to ensure this. When the water-soluble salt has a negative charge on its surface, e.g. in the case of sodium or potassium chloride, the presence of an anionic surfactantris desirable. Suitable surfactants are those of the ether sulphate type, amongst which we prefer to use that sold under the trade name "Solumin PFN 20" by ABM Chemicals Limited. Surfactants are suitably present in the core-forming mixture in an amount of 0.2–2.0% by weight, based on the weight of the mixture.

The core or inserts of the invention are made by firstly preparing a mixture of the moulding composition ingredients, i.e. the water-soluble salt, the calcium silicate, the binder, the surfactant and any other desired materials, and thoroughly mixing the ingredients. The resulting paste is granulated and then shaped into the desired core shape. Shaping may be carried out by isostatic pressing, injection moulding, compression moulding, transfer moulding, extrusion or casting. Injection moulding is a preferred procedure, and will be followed by firing of the shaped core to drive off the organic materials and sinter the particles of the water-soluble salt. Sintering has the effect of slightly fusing adjacent particles of the salt, giving a porous structure to the formed core. It is of course desirable that the degree of shrinkage of the core which occurs during sintering should be held to a minimum, and the presence in the core-forming mixture of inert materials helps to prevent this.

It is an important feature of the present invention that the particles of water-soluble salt and calcium silicate used as the major ingredients of the coreforming mixture should have a particular and special particle size distribution. Means for achieving this particle size distribution is described in detail in U.K. Specification No: 2105312A, to which reference is directed.

In order to enhance the resistance of bodies made according to the invention to adventitious water, e.g. during storage or transport, it is preferred to treat them, after forming, with a waterproofing material which is of such a nature as to be fairly readily removed at the temperatures at which the bodies are to be removed. For example, the cores may be coated, and slightly impregnated, by dipping them in an unsaturated polyester resin, e.g. that sold by Scott-Bader under the trade mark "Crystic". After dipping the resin may be cured at about 150° C. to give a surface coating providing increased strength and resistance to water attack. The resin coating may be burned off either before or during the casting process, as appropriate. Alternatively, the cores may be dipped in a silicone resin, e.g. Dow-Corning's R62230, dissolved in a volatile solvent such as trichloro-ethylene. Evaporation of the solvent leaves a coating on the core of a silicon resin which again can be burned off before or during the casting process. Burning off the resin leaves small amounts of silica in the interstices of the core. The solubility of the core is enhanced after casting.

The following example is given for the purpose of illustrating the invention.

EXAMPLE

Sodium chloride crystals, having a particle mono size in the range 150–200 μm were wet ground in ethanol. The grinding conditions were:

(i) equal volumes of sodium chloride and grinding balls;

(ii) 2 kg of sodium chloride to 1 cubic decimeter of ethanol;

(iii) 1 kg of sodium chloride to 5 cubic decimeters of mill capacity.

A core-forming mixture may be prepared from the following ingredients:

Sodium chloride 20–28% by weight;
Wollastonite 72–80% by weight;
Surfactant 0.5–1.5% by weight;
Polyethylene glycol (mw 6000) 12–19% by weight;
Diethyleneglycolmonostearate 4.8–7.6% by weight;
Di-isooctylphthalate 1.6–2.7% by weight;

A particularly suitable moulding composition comprises the following ingredients:

Sodium chloride 17.5% by weight;
Wollastonite 57% by weight;
Surfactant (solumin PFN 20) 1.00% by weight;
"Superfine molochite" (aluminosilicate) 1.7% by weight;
Polyethylene glycol (mw 6000) 15.3% by weight;
Diethyleneglycolmonostearate 5.2% by weight;
Di-isooctylphthalate 2.3% by weight;

After milling, the sodium chloride and wollastonite are treated with an anionic surface active agent in order to render them wettable by the hinder. Specifically, they are heated to 70° C. and 1% by weight of Solumin PFN 20 (A.B.M.Chemicals Limited) was added. The mixture is then thoroughly mixed for 30 minutes in a twin Z-blade mixer.

The remaining ingredients are then added to the surfactant-treated sodium chloride and wollastonite and mixing occurs for approximately 60 minutes. The paste thus formed is removed from the mixer end granulated into a size suitable for injection moulding.

Cores are moulded from these granules by injection moulding in the conventional manner, the moulding composition being at a temperature of approximately 70° C. and the temperature of the mould being approximately 25° C.

After removing the shaped core from the injection mould, it is placed in a refractory powder (e.g. alumina dust) in a refractory box (e.g. a saggar), and heated to 800° to 850° C. The rate of temperature rise is preferably not more than 20° C. per hour up to 200° C., and no more than 60° C. per hour up to 850° C. The shaped core is fired at 800° to 850° C. for from 2 to 8 hours, e.g. 6 hours, and during this forming stage all the ingredients except the sodium chloride, wollastonite and aluminosilicate are burnt off. After cooling the core may be dip-coated with an unsaturated polyester resin or with a silicone resin.

The formed core thereafter finds use in the casting of metals and metal alloys, from which it may subsequently be removed by dissolution in water. The casting techniques in which it may be used include gravity die-casting, pressure die-casting, sand casting, investment casting and other refractory mould casting techniques. The cores are of particular utility in the casting of aluminium and aluminium alloys, in magnesium casting and in zinc-based die-casting. Coefficients of expansion of the cores at the normal casting temperatures (ca.700° C.) are substantially less than 1% linear.

We claim:

1. A refractory body comprising a composition containing a water-soluble salt chosen from the class consisting of sodium chloride, potassium chloride and sodium metasilicate, and a calcium silicate, the calcium silicate being present in an amount of at least 45%, by weight, based on the total weight of calcium silicate and water-soluble salt, the water-soluble salt and the calcium silicate having the following particle size distribution:

100% by weight of the particles have a size of 750 μm or less;
90% by weight of the particles have a size of 8–600 μm;
80% by weight of the particles have a size of 5.5–500 μm;
70% by weight of the particles have a size of 4–400 μm;
60% by weight of the particles have a size of 2.8–350 μm.
50% by weight of the particles have a size of 2.0–280 μm;
40% by weight of the particles have a size of 1.6–220 μm;
30% by weight of the particles have a size of 1.0–180 μm;
20% by weight of the particles have a size of 0.3–160 μm;
10% by weight of the particles have a size of 0.1–125 μm.

2. A refractory body according to claim 1 wherein the calcium silicate is present in an amount of at least 60% by weight, on the same basis.

3. A refractory body according to claim 1 comprising, by weight, 20 to 28% water-soluble salt and 80 to 72% calcium silicate, based on the total weight of calcium silicate and water-soluble salt.

4. A refractory body according to claim 1 wherein the calcium silicate is a wollastonite.

5. A refractory body according to claim 1 wherein the calcium silicate has a particle size distribution such that 90% by weight have particle sizes less than 200 μm.

6. A refractory body according to claim 1 containing also up to 10% by weight, based on the weight of the total mixture, of a material chosen from the class consisting of silica, alumina, zircon, an aluminosilicate, talc, magnesia, titania, mullite, ground procelain, and sillimanite.

7. A refractory body according to claim 6 wherein the additional ingredient is present in an amount of 2.0 to 2.5%, on the same basis.

8. A method of manufacturing a refractory body comprising forming a mixture including a water-soluble salt, a calcium silicate and a temporary binder, said water-soluble salt and said calcium silicate having the following particle size: 100% by weight of the particles have a size of 750 μm or less;

90% by weight of the particle have a size of 8–600 μm;
80% by weight of the particles have a size of 5.5–500 μm;
70% by weight of the particles have a size of 4–400 μm;
60% by weight of the particles have a size of 2.8–350 μm;

50% by weight of the particles have a size of 2.0–280 μm;

40% by weight of the particles have a size of 1.6–220 μm;

30% by weight of the particles have a size of 1.0–180 μm;

20% by weight of the particles have a size of 0.3–160 μm;

10% by weight of the particles have a size of 0.1–125 μm;

shaping the mixture into the desired body form; and firing the form to remove the binder.

9. A method according to claim 8 wherein the temporary binder is chosen from the class consisting of a paraffin wax, a synthetic organic resin and a silicone resin.

10. A method according to claim 8 wherein the temporary binder is a polyethylene glycol.

11. A method of producing a casting of a castable metal or alloy, comprising:

forming a mould having a composition of a water-soluble salt chosen from the class consisting of sodium chloride, potassium chloride, and sodium metasilicate, and a calcium silicate, the calcium silicate being present in an amount of at least 45%, by weight, based on the total weight of calcium silicate and the water-soluble salt, the water-soluble salt and the calcium silicate having the following particle size distribution:

100% by weight of the particles have a size of 750 μm or less;

90% by weight of the particles have a size of 8–600 μm;

80% by weight of the particles have a size of 5.5–500 μm;

70% by weight of the particles have a size of 4–400 μm;

60% by weight of the particles have a size of 2.8–350 μm;

50% by weight of the particles have a size of 2.0–280 μm;

40% by weight of the particles have a size of 1.6–220 μm;

30% by weight of the particles have a size of 1.0–180 μm;

20% by weight of the particles have a size of 0.3–160 μm;

10% by weight of the particles have a size of 0.1–125 μm;

introducing into the mould assembly a charge of the castable metal or alloy in molten form;

allowing the charge to solidify; and removing the mould from the casting so formed.

* * * * *